US006972058B1

(12) United States Patent
Underys

(10) Patent No.: US 6,972,058 B1
(45) Date of Patent: Dec. 6, 2005

(54) HEAT TREATMENT METHOD AND APPARATUS

(75) Inventor: Algirdas A. Underys, Arlington Heights, IL (US)

(73) Assignee: A. Finkl & Sons Co., Chicago, IL (US)

( * ) Notice: Subject to any disclaimer, the term of this patent is extended or adjusted under 35 U.S.C. 154(b) by 0 days.

(21) Appl. No.: 08/991,113

(22) Filed: Dec. 16, 1997

(51) Int. Cl.[7] ..... C21D 1/34
(52) U.S. Cl. ..... 148/525; 148/565; 148/633; 148/656
(58) Field of Search ..... 148/525, 565, 148/633, 656

(56) References Cited

U.S. PATENT DOCUMENTS 4,221,956 A * 9/1980 Fielding et al. ..... 219/388
4,224,504 A * 9/1980 Erikson et al. ..... 219/388
4,540,876 A * 9/1985 McGinty ..... 219/405
4,620,884 A * 11/1986 Heath ..... 148/633
4,868,371 A * 9/1989 Crossley et al. ..... 219/464
6,013,900 A * 1/2000 Westerberg et al. ..... 219/405
6,174,388 B1 * 1/2001 Sikka et al. ..... 148/512
6,398,885 B1 * 6/2002 Finkl et al. ..... 148/565

* cited by examiner

*Primary Examiner*—George Wyszomierski

(74) *Attorney, Agent, or Firm*—James G. Staples

(57) ABSTRACT

A method of heat treating tool steel by using a high intensity infrared heating source, said source being tungsten halogen heat lamps which operate in air, non-air and/or vacuum environments, and a tool steel heat treat system which includes a furnace containing said tungsten halogen lamp means, a lining of a reflective metal and, preferably, support structure for the tool steel workpieces which are composed of ceramic or other high melting point material.

8 Claims, No Drawings

HEAT TREATMENT METHOD AND APPARATUS

This invention pertains generally to heat treating metals and specifically to a heat treatment method and apparatus which avoids all, or substantially all, of the drawbacks of the currently employed heat treatment methods and apparatus associated with the metals of choice as below described. Although the invention is believed to be applicable to metals whose properties can be modified by application of heat, it is currently contemplated that its initial application will be in ferrous metallurgy and accordingly the invention will be hereafter described, in an exemplary fashion, as applied to ferrous metallurgy and specifically the heat treatment of tool steels.

BACKGROUND OF THE INVENTION

Tool steels are typically sold in the annealed condition and are heat treated after machining to obtain the desired strength and other properties. At the current time it is believed that all, or substantially all, heat treatment of tool steel is carried out in air, under a protective medium, or in a vacuum.

Heat treating, by the application of heat to a workpiece from a heat source in air affects the surface of the workpiece, that is, the surface is decarburized. As a result a stock allowance over the finished size is required in order to remove the decarburized layer after heat treatment. As a consequence the heat treatment cycle of the workpiece is lengthened, a further expensive processing step, machining, must be performed and the chemical composition, and the physical and performance characteristics attributable thereto, may be affected since the depth of decarburization may vary from location to location on the workpiece. Cycle length increase and machining translate directly into increased costs and indirect disadvantages such as customer dissatisfaction with long delivery times. Obviously additional capital equipment costs are incurred and resultant effect costs, such as additional chip removal and handling, are experienced.

Heating in a protective medium eliminates the above described decarburization problem but adds environmental, safety and production problems. Protective mediums can be gases or liquids. Protective gases can be hydrocarbon based (carbon monoxide, carbon dioxide, methane, hydrogen, etc.), or a combination of both types of gases. Protective liquids can be salt, lead or zinc baths.

Heat sources can act as ignition sources for the protective gaseous media which are usually combustible, of which methane is an example, and can result in damaging explosions. Typically, furnaces that use protective atmospheres rely on a metallic or ceramic device, such as radiant tubes or muffles, to separate the heat source from the protective atmosphere. These devices increase the cost of the system in terms of original equipment costs as well as maintenance costs. Such devices also separate the heat source from the workpiece to be heated, thereby decreasing heating efficiency significantly and affecting productivity. In summary, controlling the environmental problems associated with heat treating using a protective medium (such as the direct discharge of hydrocarbons to the atmosphere, the health hazards of lead, and the health and safety issues with molten salts) can be a significant heat treatment expense.

Heating under a vacuum also eliminates the decarburization problem and does not have any detrimental environmental or safety effects. Heat treating under vacuum, however, poses different operation challenges. Thus, many types of heating elements used in vacuum furnaces will sublime, ignite or oxidize if exposed to air at elevated temperatures. Mechanical failures of the vacuum system would not only subject the load to decarburization, but would also damage the very expensive heating elements. Productivity also suffers because the only mode of transferring heat from the heating elements to the stock when under vacuum is through radiation; i.e.: there is no convection effect.

SUMMARY OF THE INVENTION

The invention consists of heat treating tool steel by the use of high intensity infrared heating developed form a source of infrared heat energy.

DETAILED DESCRIPTION OF THE INVENTION

The source of infrared heat energy is, preferably, tungsten halogen tubes, and this heat source will be assumed in the following detailed description of the invention. It is believed that other infrared heat energy sources could be utilized however. In a tungsten halogen system the tungsten element and the halogen gas are located within a sealed quartz tube.

The tungsten halogen tubes can be operated in air, in protective gases or in vacuum with no detrimental effects to the tube. The ability of the high intensity infrared heat source to heat in a non-air atmosphere or under vacuum eliminates the environmental and safety issues of other heat treatment methods in those mediums.

With respect to equipment it is believed that existing heat treatment furnaces can be used with little or no modification, or, preferably, with selective modification.

Thus, in order to concentrate the heat energy on to the tool steel, a high reflective surface should be present on the interior surfaces of the furnace walls. A thin coating of gold, or silver, or aluminum over some or substantially all of the interior surfaces of the furnace will be quite suitable.

In operation the workpieces should preferably be placed as close together as convenient since the beamed heat energy cannot distinguish between a workpiece and the workpiece support structure. Ceramic or other high melting point support structures should be used to support the workpieces to the extent practical. From a processing parameter standpoint, the time of heat application will be close to the parameters currently used. Thus if two inch thick rods or bars are to be heat treated a relatively short treatment period may be all that is required and in all probability the time curves already formulated for two inch thick workpieces in existing furnaces can be used in an infrared furnace. By the same token, if a block having a 10" by 10" cross-section is to be heat treated a substantially longer processing time will be required due to the time lag of the temperature rise in the center of the workpiece. With irregularly shaped workpieces the maximum thickness will be the governing factor subject to judgment determinations which are within the skill of the art, such as the phenomenon of grain growth, which is usually undesirable, in long heating cycles. It will be understood that precise operating parameters cannot be set forth since these parameters are, to a large extent, unique to each heat treatment furnace. Slight variances from standard practice may be necessary in many installations and substantial adjustments in a few. Common to all cases however, is the fact that the heat source is infrared heat energy, preferably from tungsten halogen lamps, which are placed in as close juxtaposition to the tool steel as possible. Tungsten halogen lamps capable of generating a temperature of up to 5000° F. in a workpiece located in close proximity can be utilized. It will be appreciated that the tungsten halogen system will heat in air and in non-air mediums, such as nitrogen, by both radiation and convection.

Although a specific example, and modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

What is claimed is:

1. In a method of heat treating bars, blocks and other metal workpieces the steps of providing a heat treatment furnace of a size suitable to receive a workpiece to be heat treated, providing a heat source in the interior of the furnace consisting of a source of infrared heat energy, subjecting the workpiece to heat treatment by exposing said workpiece to infrared heat energy from the infrared heat energy source and maintaining said workpiece stationary during subjection of the workpiece to heat treatment from the infrared energy source.

2. The method claim 1 further characterized by and including the step of providing a coating of reflective material over at least some of the interior surface of the furnace.

3. The method of claim 1 further including the step of providing a ceramic or other high melting point support structure to support the metal workpiece.

4. The method of claim 1 further including the step of providing an air atmosphere in the furnace.

5. The method of claim 1 further including the step of providing a non-air environment in the furnace.

6. The method of claim 1 further including the step of providing a vacuum environment in the furnace.

7. In a method of heat treating bar, block and other metal workpieces the steps of providing a heat treatment furnace of a size suitable to receive a workpiece to be heat treated, providing a source of infrared heat energy in the interior of the furnace consisting of tungsten halogen lamp means, subjecting the workpiece to heat treatment by exposing said workpiece to infrared heat energy from the tungsten halogen lamp means and maintaining said workpiece stationary during subjection of the workpiece to heat treatment from the infrared energy source.

8. In a method of heat treating a metal workpiece the steps of providing a heat source in the interior of a furnace of a size suitable to receive a workpiece to be heat treated, providing a coating of reflective material selected from the group consisting of gold, silver and aluminum over at least some of the interior surface of the furnace, and subjecting the workpiece to heat treatment by exposing said workpiece to infrared heat energy from an infrared heat energy source.

* * * * *